US005382507A

United States Patent [19]

Shimizu et al.

[11] Patent Number: 5,382,507

[45] Date of Patent: Jan. 17, 1995

[54] METHOD FOR PROCESSING BLACK-AND-WHITE SILVER HALIDE PHOTOGRAPHIC LIGHT-SENSITIVE MATERIALS

[75] Inventors: Akira Shimizu; Shoji Nishio; Takeshi Sanpei; Hiroyuki Ushiroyama, all of Hino, Japan

[73] Assignee: Konica Corporation, Japan

[21] Appl. No.: 183,487

[22] Filed: Jan. 19, 1994

[30] Foreign Application Priority Data

Jan. 21, 1993 [JP] Japan ..... 5-026132

[51] Int. Cl.[6] ..... G03C 1/33; G03C 1/34; G03C 5/305; G03C 5/31

[52] U.S. Cl. ..... 430/399; 430/435; 430/438; 430/465; 430/485; 430/491; 430/490; 430/599; 430/600; 430/642

[58] Field of Search ..... 430/399, 435, 438, 465, 430/485, 491, 490, 599, 600, 309, 642

[56] References Cited

U.S. PATENT DOCUMENTS

| | | | |
|---|---|---|---|
| 4,318,979 | 3/1982 | Habu et al. | 430/600 |
| 4,816,384 | 3/1989 | Fruge et al. | 430/435 |
| 4,988,603 | 1/1991 | Takamuki et al. | 430/438 |
| 5,041,363 | 8/1991 | Sakuma | 430/435 |
| 5,139,921 | 8/1992 | Takagi et al. | 430/438 |

*Primary Examiner*—Janet C. Baxter
*Assistant Examiner*—Mark F. Huff
*Attorney, Agent, or Firm*—Jordan B. Bierman

[57] ABSTRACT

A method for processing a first black-and-white silver halide photographic light-sensitive material comprising a hydrazine compound and a second black-and-white silver halide photographic light-sensitive material comprising a tetrazolium compound is disclosed, a photographic layer on the side of a silver halide emulsion layer of each material containing gelatin in an amount of not more than 3.0 g per $m^2$ of the material, and the process comprising the step of exposing the light-sensitive materials and developing the exposed materials with the same developer having a pH of from 9.5 to 10.7, the developer being replenished with developer replenisher in an amount of not more than 250 cc per $m^2$ of the light-sensitive materials to be developed.

10 Claims, No Drawings

METHOD FOR PROCESSING BLACK-AND-WHITE SILVER HALIDE PHOTOGRAPHIC LIGHT-SENSITIVE MATERIALS

FIELD OF THE INVENTION

The present invention relates to a method for processing a black-and-white silver halide photographic light-sensitive material.

BACKGROUND OF THE INVENTION

Since a silver halide light-sensitive material used making a printing plate is required to have a high contrast, there are generally used a technique to incorporate a tetrazolium compound in a light-sensitive material as described in Japanese Pat. Exam. Pub. Nos. 17821/1964, 5936/1985 as well as a technique to incorporate a hydrazine compound in a light-sensitive material as described in U.S. Pat. No. 4,269,929.

However, a tetrazolium compound containing light-sensitive material and a hydrazine compound containing light-sensitive material are different from each other in reaction mechanism for improving the contrast. To be concrete, in a tetrazolium compound containing light-sensitive material, a tetrazolium compound acts as a reducing agent in the developing process and thereby improves the contrast by depressing the development of a silver halide which is low in exposure. On the other hand, in a hydrazine compound containing light-sensitive material, a hydrazine compound acts as an oxidizing agent and thereby improves the contrast by accelerating the development of a silver halide which is rich in exposure. Because of such reaction mechanisms contrary each other, a tetrazolium compound containing light-sensitive material and a hydrazine compound containing light-sensitive material cannot be processed in the same developer. For example, when a hydrazine compound containing light-sensitive material is processed in a developer where a tetrazolium compound containing light-sensitive material is being processed, a tetrazolium compound dissolved from the light-sensitive material into the developer reacts with a hydrazine compound, inactivating the contrast-improving function. In a converse case, the contrast-improving function is lost, too.

At the use of a light-sensitive material, users select appropriate one depending upon the purpose such as photographing, contact or scanning. Since a tetrazolium compound containing light-sensitive material and a hydrazine compound containing light-sensitive material have merits and demerits respectively in contrast-improving function and other photographic properties, it is preferred that a light-sensitive material most suitable for the purpose be selected by taking such merits and demerits into consideration. However, when light-sensitive materials selected by an user are different in process for improving the contrast, different developers and different automatic processors are needed according to the materials selected, imposing a burden on user. Such being the case, there has been demanded a process which makes it possible to employ the same developer and the same automatic processor irrespectively of contrast-improving process.

There are various supplying methods of a processing solution for a photographic light-sensitive material.

In photographic processing carried out with an automatic processor to develop, fix and bleach the light-sensitive material, a specific amount of processing agents is supplied as replenishers to the processor to compensate loss of processing solutions caused by being taken out together the light-sensitive material to be processed or by being evaporated, oxidized or deteriorated. Such replenishers are generally sold in the form of concentrated solutions to be diluted with water when used.

However, undesirable problems sometimes arise in the method where such concentrated solutions are diluted. To be concrete, when a light-sensitive material is processed with a developer containing a conventional polyhydroxy benzene type developing agent, problems do not arise as long as processing is carried out at normal intervals, but when processing leaves a processing solution unreplenished at long intervals, the solution allows air oxidation to proceed, resulting in deteriorating the developer's activity and thereby lowering the photographic sensitivity. For example, when a light-sensitive material is processed, the operation of the automatic developer is closed at night and a light-sensitive material of the same kind is processed on the following morning, the sensitivity of the latter light-sensitive material fluctuates much more than that of the former light-sensitive material. In such a case, the activity of the developer must be restored by supplying a large amount of developer replenisher and, as a result, the efficiency of operation is lowered to a large extent.

Further, in a recent processing system which uses a replenisher in a small amount for minimizing the amount of photographic waste liquor in view of environmental protection, a processing solution in running state is low in activity because of a small replenishing amount, while the tolerance for deterioration in developer activity has become very small owing to shortening of developing time brought about by the recent tendency toward more rapid developing. To cope with such a problem, there have so far been made various attempts such as thinning of a light-sensitive material by decreasing the binder amount used in a light-sensitive material, minimization of deterioration in developing activity by lessening the amount of silver halide contained in a light-sensitive material, and raise of developing temperature. However, these attempts are not effective enough to solve the problem, and the lowering in photographic sensitivity becomes intensified in photographic operation. In addition, disposal of waste processing solutions becomes difficult because of organic solvents contained therein; therefore, decrease in amount of organic solvents, generally contained in a processing solution is strongly demanded.

SUMMARY OF THE INVENTION

Accordingly, an object of the present invention is to provide a technique to process stably light-sensitive materials different in contrast-improving function using the same developer and, more particularly, to provide a method for processing stably both of a tetrazolium compound containing light-sensitive material and a hydrazine compound containing light-sensitive material with the same developer. Another object of the present invention is to reduce a replenishing amount of a developer. Still another object of the present invention is to decrease the amount of solvent contained in a developer. A further object of the present invention is to improve the handling property by changing a processing solution to a solid form.

DETAILED DESCRIPTION OF THE INVENTION

The above objects of the present invention are achieved by a method for processing a first black-and-white silver halide photographic light-sensitive material comprising a support and provided thereon, a photographic component layer containing a hydrazine compound and a second black-and-white silver halide photographic light-sensitive material comprising a support and provided thereon, a photographic component layer containing a tetrazolium compound, each photographic component layer on the side of an silver halide emulsion layer containing gelatin in an amount of not more than 3.0% by weight per $m^2$ of the material, comprising the step of:

exposing the light-sensitive materials;

developing the exposed materials with the same developer having a pH of from 9.5 to 10.7, said developer containing a chelating agent, and a silver stain inhibitor, said developer being replenished with developer replenisher in an amount of not more than 250 cc per $m^2$ of the light-sensitive materials to be developed; and fixing the developed materials with fixer.

The hydrazine compound used in the invention is hereinafter described. The dissolution-inhibiting group contained in the hydrazine compound of the invention is a ballast group having preferably 6 or more carbon atoms and more preferably 10 or more carbon atoms or an adsorptive group group having a mercapto group or a nitrogen-containing heterocycle. Examples thereof include the following groups:

Examples of the dissolution-inhibiting group contained in the hydrazine compound Examples of the ballast group and the adsorptive group

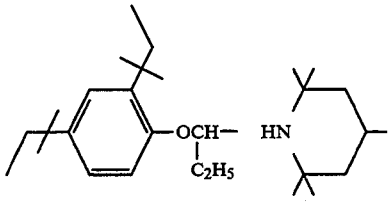

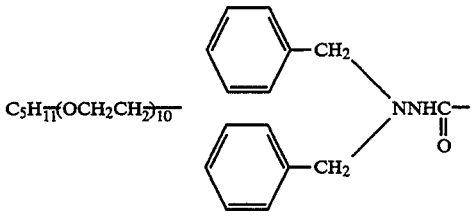

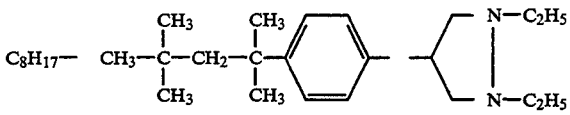

The hydrazine compound contained in a light-sensitive material to be processed according to the invention is preferably one represented by the following formula (H):

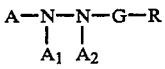

formula (H)

In the formula, A represents an aryl group or a heterocyclic group containing at least one sulfur or oxygen atom; G represents a

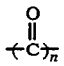

group, a sulfonyl group, a sulfoxy group, a

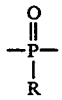

group or an iminomethylene group;

n represents an integer of 1 or 2; $A_1$ and $A_2$ represent hydrogen atoms concurrently, or one of them represents a hydrogen atom and the other represents a substituted or unsubstituted alkylsulfonyl group or a substituted or unsubstituted acyl group; R represents a hydrogen atom, an alkyl, aryl, alkoxy, aryloxy, amino, carbamoyl or oxycarbamoyl qroup, or —O—$R_2$, wherein $R_2$ represents a saturated heterocyclic group.

Among these hydrazine compounds, those represented by the following formula (H-c) or (H-d) are preferred in the embodiment of the invention.

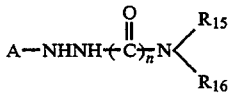

formula (H-c)

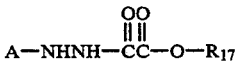

formula (H-d)

In the formula, A represents an aryl group or a heterocyclic group containing at least one sulfur or oxygen atom, and n represents an integer of 1 or 2. When n is 1, $R_{15}$ and $R_{16}$ each represent a hydrogen atom or an alkyl, alkenyl alkynyl, aryl, heterocyclic, hydroxyl, alkoxy, alkenyloxy, alkynyloxy, aryloxy or heterocycloxy group, provided that $R_{15}$ and $R_{16}$ may form a ring together with a nitrogen atom. When n is 2, $R_{15}$ and $R_{16}$ each represent a hydrogen atom or an alkyl, alkenyl, alkynyl, aryl, saturated or unsaturated heterocyclic, hydroxyl, alkoxy, alkenyloxy, alkynyloxy, aryloxy or heterocycloxy group, provided that at least one of $R_{15}$ and $R_{16}$ is an alkenyl, alkynyl, saturated heterocyclic, hydroxyl, alkoxy, alkenyloxy, alkynyloxy, aryloxy or heterocycloxy group. $R_{17}$ represents an alkynyl or saturated heterocyclic group.

The compounds represented by formula (H-c) or (H-d) include those in which at least one of H in the group of —NHNH— is replaced by a substituent.

To be more precise, A represents an aryl group such as phenyl, naphthyl, or a heterocyclic group containing at least one sulfur or oxygen atom such as thiophene, furan, benzothiophene, pyran.

$R_{15}$ and $R_{16}$ each represents a hydrogen atom; an alkyl group such as methyl, ethyl, methoxyethyl, cyanoethyl, hydroxyethyl, benzyl, trifluoroethyl; an alkenyl group such as allyl, butenyl, pentenyl, pentadienyl;

an alkynyl group such as propargyl, butynyl, pentynyl; an aryl group such as phenyl, naphthyl, cyanophenyl, methoxyphenyl; a heterocyclic group including an unsaturated heterocyclic group such as pyridine, thiophene, furan and a saturated heterocyclic group such as tetrahydrofuran, sulfolane; a hydroxyl group; an alkoxy group such as methoxy, ethoxy, benzyloxy, cyanomethoxy; an alkenyloxy group such as allyloxy, butenyloxy; an alkynyloxy group such as propargyloxy, butynyloxy; an aryloxy group such as phenoxy, naphthyloxy; or a heterocycloxy group such as pyridyloxy, pyrimidyloxy. When n is 1, $R_{15}$ and $R_{16}$ may form a ring, such as a piperidine, piperazine or morpholine ring, jointly with a nitrogen atom.

When n is 2, however, at least one of $R_{15}$ and $R_{16}$ is an alkenyl, alkynyl, saturated heterocyclic, hydroxyl, alkoxy, alkenyloxy, alkynyloxy, aryloxy or heterocycloxy group.

Examples of the alkynyl group or saturated heterocyclic group represented by $R_{17}$ include those described above.

A variety of substituents may be introduced into the aryl group or heterocyclic group having at least one sulfur or oxygen atom. Examples of such substituents include halogen atoms and the groups of alkyl, aryl, alkoxy, aryloxy, acyloxy, alkyloxy, arylthio, sulfonyl, alkoxycarbonyl, aryloxycarbonyl, carbamoyl, sulfamoyl, acyl, amino, alkylamino, arylamino, arylamino, sulfonamido, arylaminothiocarbonylamino, hydroxyl, carboxyl, sulfo nitro, cyano, etc. Of these substituents, preferred is a sulfonamido group.

In each of the above formulas, it is preferred that A contain at least one non-diffusible group or group which accelerates adsorption of silver halides. A preferred example of the non-diffusible group is a ballast group which is commonly used in immovable photographic additives such as couplers. Such a ballast group, a group having 8 or more carbon atoms and relatively inactive to photographic properties, can be selected, for example, from the groups of alkyl, alkoxy, phenyl, alkylphenyl, phenoxy and alkylphenoxy.

Examples of the group which accelerates adsorption of silver halides include the groups described in U.S. Pat. No. 4,385,108 such as thiourea, thiourethane, heterocyclic thioamido, heterocyclic mercapto and triazole groups.

H in the group of —NHNH— contained in formula (H-c) or (H-d), or a hydrogen atom in the hydrazine structure, may be replaced by a substituent selected from a sulfonyl group such as methanesulfonyl or toluenesulfonyl; an acyl group such as acetyl, trifluoroacetyl or ethoxycarbonyl; and an oxalyl group such as ethoxalyl or pyruvoyl; that is, the compound represented by formula (H-c) or (H-d) includes those substituted as described above.

In the embodiment of the invention, preferred are compounds of formula (H-c) wherein n being 2 and compounds of formula (H-d).

In the compounds of n being 2 in formula (H-c), particularly preferred are those in which $R_{15}$ and $R_{16}$ independently represent a hydrogen atom or an alkyl, alkenyl, alkynyl, aryl, saturated or unsaturated heterocyclic, hydroxyl or alkoxy group, and at least one of $R_{15}$ and $R_{16}$ represents an alkenyl, alkynyl, saturated or unsaturated heterocyclic, hydroxyl or alkoxy group.

The following are examples of the compound represented by formula (H-c) of (H-d). However, as a matter of course, the compound of formula (H-c) or (H-d) usable in the invention is not limited to these examples.

Examples of the compound

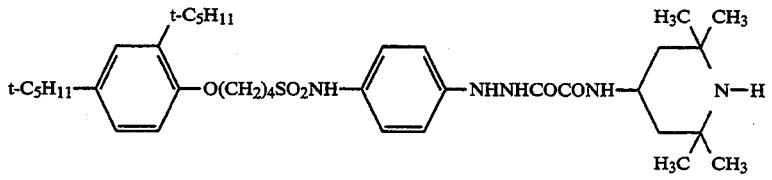

c-1

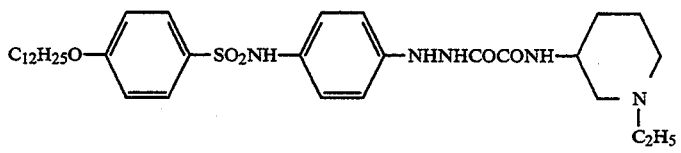

c-2

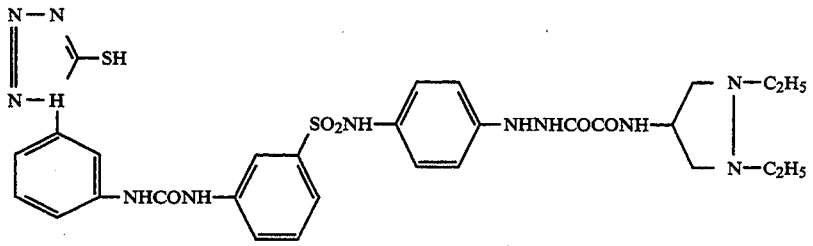

c-3

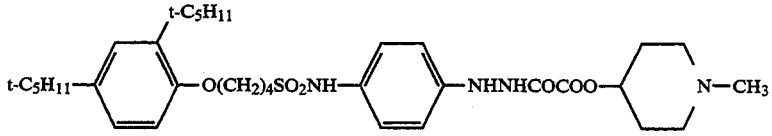

d-1

-continued
Examples of the compound
c-4
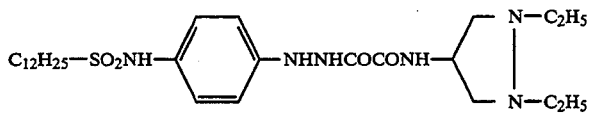
c-5
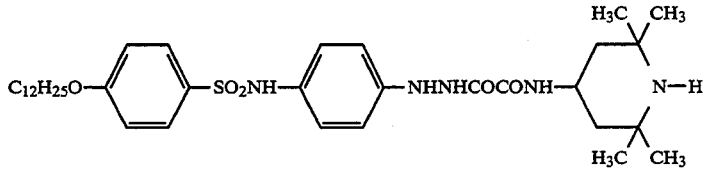
d-2
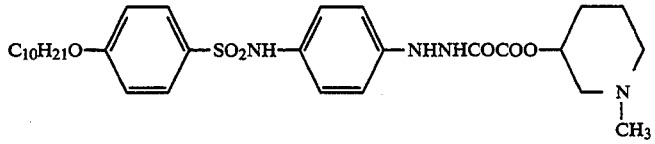
c-6
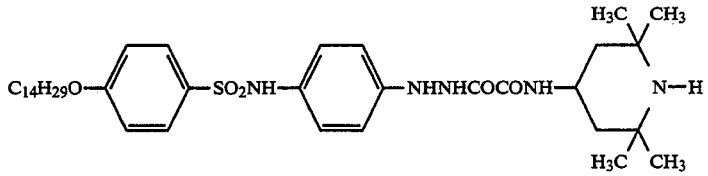
d-3
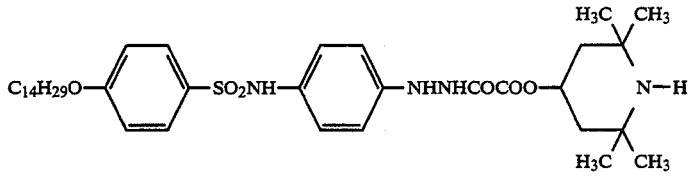
c-7
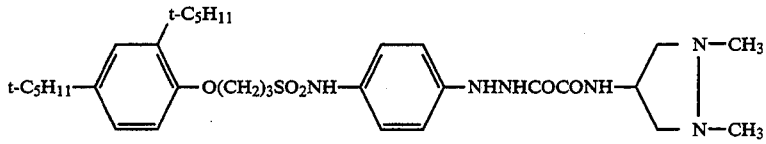
d-4
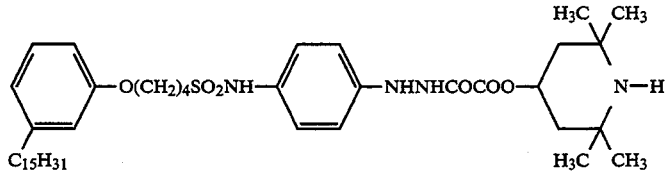
c-8
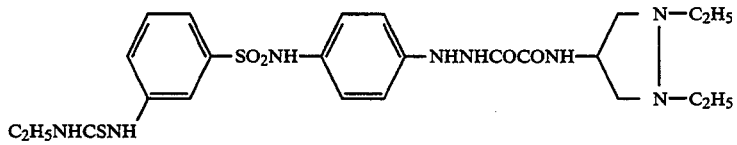
d-5
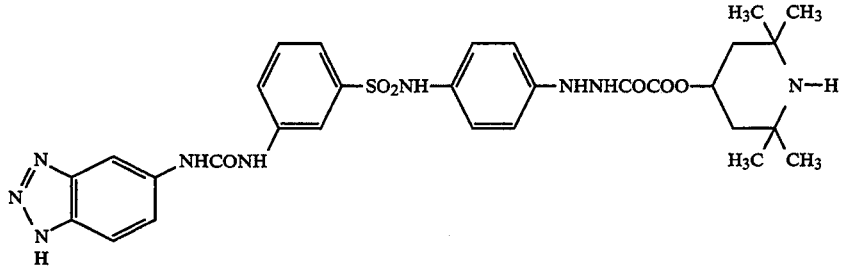
Examples of other usable compounds include compound Nos. 1 to 61 and 65 to 75 illustrated on pages The hydrazine compound used in the invention can be synthesized according to the method described on pages 546–550 (8–12) of Japanese Pat. O.P.I. Pub. No. 841/1990.

The hydrazine compound of the invention is added to a silver halide emulsion layer and/or its adjacent layer in an amount of preferably $1\times10^{-6}$ to $1\times10^{-1}$ mol per mol of silver, and more preferably $1\times10^{-5}$ to $1\times10^{-2}$ mol per mol of silver.

When the hydrazine compound of formula (H-c) or (H-d) is used, it is preferred that at least one of the nucleation accelerators illustrated from the first line in the lower left column on page 7 to the 11th line of the lower left column on page 26 of Japanese Pat. O.P.I. Pub. No. 98239/1992 be contained in a silver halide emulsion layer and/or a nonlight-sensitive layer provided on a support oppositely with the silver halide emulsion layer.

Typical examples of the nucleation accelerators are those illustrated below:

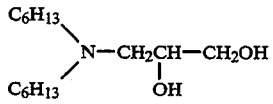
N-1

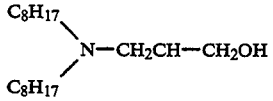
N-2

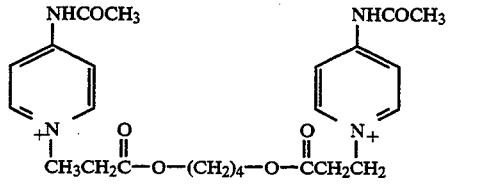
N-3

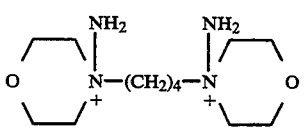
N-4

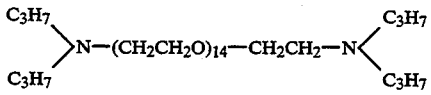
N-5

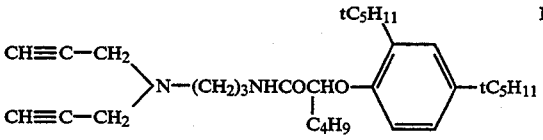
N-6

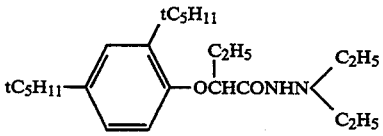
N-7

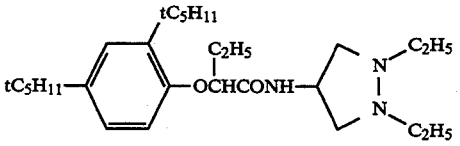
N-8

-continued

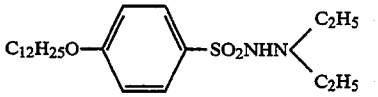
N-9

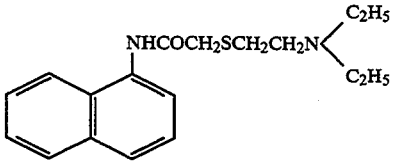
N-10

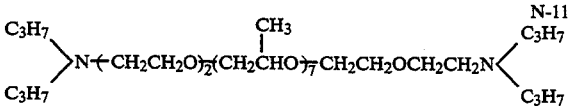
N-11

A variety of usable nucleation accelerators are illustrated in Japanese Pat. O.P.I. Pub. No. 98239/1992. Such nucleation accelerators include, though some of them are already illustrated as the above typical examples, compounds I-1 to I-26 illustrated on page 8 of the above patent specification, compounds II-1 to II-29 on pages 9–10, compounds III-1 to III-25 on pages 10–11, compounds IV-1 to IV-41 on pages 84–90, compounds V-I-1 to V-I-27 on pages 11–13, compounds V-II-1 to V-II-30 on pages 13–14, compound V-III-35 on page 16, compounds VI-I-1 to VI-I-44 on pages 18–20, compounds VI-II-1 to VI-II-68 on pages 21–24, and compounds VI-III-1 to VI-III-35 on pages 24–26.

The tetrazolium compound used in the light-sensitive material of the invention is generally represented by the following formula (T). Preferred are those having a dissolution-inhibiting group, of which suitable examples include a substituted or unsubstituted phenyl group.

formula (T)

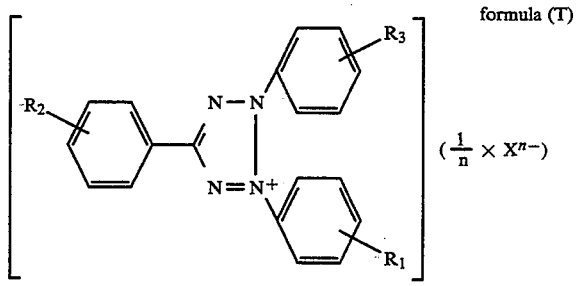

In the embodiment of the invention, $R_1$, $R_2$ and $R_3$ on the phenyl group of the triphenyltetrazolium compound represented by formula (T) independently represent a hydrogen atom or a group having a negative or positive Hammett's sigma value ($\sigma P$), which is a measure of the electron withdrawing property. Preferred are those having a negative Hammett's sigma value.

Details of Hammett's sigma value in phenyl substitution can be seen in various literatures, for example, in C. Hansch's report in Journal of Medical Chemistry, Vol. 20, p. 304 (1977).

Those having a particularly preferred negative sigma value include, for example, the groups of methyl ($\sigma P$: −0.17, a value hereinafter given in parentheses is $\sigma P$), ethyl (−0.15), cyclopropyl (−0.21), n-propyl (−0.13), iso-propyl (−0.15), cyclobutyl (−0.15), n-butyl (−0.18), iso-butyl (−0.20), n-pentyl (−0.15), cyclohexyl (−0.22), amino (−0.66), acethylamino (−0.15), hydroxyl (−0.37), methoxy (−0.27), ethoxy (−0.24), propoxy (−0.25), buthoxy (−0.32) and pentoxy (−0.34), each of which is useful as a substituent on the phenyl of the compound of the invention represented by formula (T).

n represents 1 or 2.

The action represented by $X^-$ includes, for example, halogen ions such as a chloride ion, a bromide ion, or a iodide ion; acid residues of inorganic acids such as nitric acid, sulfuric acid, perchloric acid; acid residues of organic acids such as sulfonic acids, carboxylic acids; and anionic surfactants. Typical examples include lower alkylbenzene sulfonic acid anions such as a p-toluenesulfonic acid anion; higher alkylbenzene sulfonic acid anions such as a p-dodecylbenzene sulfonic acid anion; higher alkyl sulfate anions such as a lauryl sulfate anion; boron type anions such as a tetraphenyl boron; dialkyl sulfosuccinate anions such as a di-2-ethylhexyl sulfosuccinate anion; polyether alcohol sulfate anions such as acetyl polyethenoxy sulfate anion; higher fatty acid anions such as a stearic acid anion; and polymers having acid residues such as a polyacrylic acid anion.

Typical examples of the compound represented by formula (T) are illustrated below, but suitable tetrazolium compounds are by no means limited to them.

| Compound No. | $R_1$ | $R_2$ | $R_3$ | $X^{n-}$ |
|---|---|---|---|---|
| T-1 | H | H | p-$CH_3$ | $Cl^-$ |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | P-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | Cl |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-NH2 | H | $Cl^-$ |
| T-17 | p-NH2 | H | H | $Cl^-$ |
| T-18 | p-$CH_3$ | H | p-$CH_3$ | $ClO_4^-$ |

The above tetrazolium compounds can be easily synthesized, for example, by the method described in Chemical Reviews, Vol. 55, pp. 335–483.

The tetrazolium compounds represented by formula (T) may be used singly or in combination of two or more kinds at a proper ratio.

In a preferred embodiment of the invention, the monodispersion degree of silver halide grains contained in a light-sensitive material is adjusted to 5 to 60, especially 8 to 30. In the present specification, the size of silver halide grains is expressed by the edge length of a cubic grain for convenience, and the monodispersion degree is given by centupling the value obtained by dividing a standard deviation of grain size distribution by an average grain size.

As silver halide grains contained in a light-sensitive material to be processed, grains having multi-layer structure comprising at least two layers are preferred. There can be used, for example, silver chlorobromide grains having a silver chloride core and a silver bromide shell, or silver chlorobromide grains having a silver bromide core and a silver chloride shell. Silver iodide may also be contained in any of these layers in amounts not more than 5 mol %.

Further, there can be used a mixture containing at least two kinds of grains. Examples of such a mixture include those in which principal grains are cubic, octahedral or tabular silver chloroiodobromide grains containing 10 mol % or less silver chloride and 5 mol % or less silver iodide, and secondary grains are cubic, octahedral or tabular silver chloroiodobromide grains containing 5 mol % or less silver iodide and 50 mol % or more silver chloride. When such a mixture is used, while chemical sensitization of principal and secondary grains is optional, secondary grains may be made lower than principal grains in sensitivity by refraining chemical sensitization (e.g., sulfur sensitization or gold sensitization), or may be lowered in sensitivity by adjusting the grain size or the amount of noble metals, such as rhodium, used to dope grains. Further, the inside of secondary grains may be fogged by use of a gold compound or by changing the compositions of cores and shells according to the core/shell method. The size of principal grains and secondary grains can take any value within the range of 0.025 μm to 0.0 μm, though photographic properties become better with decrease in size of these grains.

In preparing a silver halide emulsion used in the invention, a rhodium salt may be added thereto for the purpose of controlling sensitivity or gradation. Preferably, the addition of a rhodium salt is made in the process of grain formation, but it may be made during chemical ripening or the time of preparing an emulsion coating solution.

The rhodium salt added to a silver halide emulsion used in the invention may be either a simple salt or a double salt. Typically, rhodium chloride, rhodium trichloride and rhodium ammonium chloride are used.

The addition amount of these rhodium salts can be varied according to desired sensitivities or gradations, but the addition amount within a ranging of $10^{-9}$ mol to $10^{-4}$ mol per mol of silver is particularly effective.

Further, other inorganic compounds, such as iridium salts, platinum salts, thallium salts, cobalt salts and salts, may be used jointly with the rhodium salts. Iridium salts can be favorably used in amounts of $10^{-9}$ mol to $10^{-4}$ mol per mol of silver to improve high intensity properties.

Silver halides used in the invention can be sensitized by use of various chemical sensitizers. As such sensitizers, there can be used, singly or in combination of two or more kinds, ones selected from active gelatins; sulfur sensitizers such as sodium thiosulfate, allyl thiocarbamide, thiourea, allyl isothiocyanate; selenium sensitizers such as N,N-dimethyl selenourea, selenourea; reduction sensitizers such as triethylenetetramine, stannous chloride; and a variety of noble metal sensitizers represented by potassium chloroaurine, potassium aurithiocyanate, potassium chloroaurate, 2-aurosuifobenzothiazole methyl chloride, ammonium chloropalladate, potassium chloroplatinate, sodium chloropalladite. When gold sensitizers are used, ammonium thiocyanate may be employed as an auxiliary sensitizer.

The silver halide emulsions used in the invention may employ desensitizing dyes and/or ultraviolet absorbents described in, for example, U.S. Pat. Nos. 3,567,456, 3,615,639, 3,579,345, 3,615,608, 3,598,596, 3,598,955, 3,592,653, 3,582,343, and Japanese Pat. Exam. Pub. Nos. 26751/1965, 27332/1965, 131167/1968, 8833/1970, 8746/1972.

Further, the silver halide emulsions used in the invention can be stabilized by use of the compounds described in, for example, U.S. Pat. Nos. 2,444,607, 2,716,062, 3,512,982, German Auslegeschrift Nos. 1,189,380, 2,058,626, 2,118,411, Japanese Pat. Exam. Pub. No. 4133/1968, U.S. Pat. No. 3,342,596, Japanese Pat. Exam. Pub. No. 4417/1972, German Auslegeschrift No. 2,149,789, Japanese Pat. Exam. Pub. Nos. 2825/1964, 13566/1974; preferred examples thereof include 5,6-trimethylene-7-hydroxy-s-triazolo(1,5-a)pyrimidine, 5,6-tetramethylene-7-hydroxy-s-triazolo(1,5-a)pyrimidine, 5-methyl-7-hydroxy-s-triazolo(1,5-a)pyrimidine, 7-hydroxy-s-triazolo(1,5-a)pyrimidine, 5-methyl-6-bromo-7-hydroxy-s-triazolo(1,5-a)pyrimidine, gallares such as isoamyl gallate, dodecyl gallate, propyl gallate, sodium gallate, mercaptans such as 1-phenyl-5-mercaptotetrazole, 2-mercaptobenzothiazole, benzotriazoles such as 5-bromobenzotriazole, 5-methylbenzotriazole, and benzimidazoles such as 6-nitrobenzimidazole.

In order to enhance the developability of the light-sensitive material, developing agents such as phenidone and hydroguinone and inhibitors such as benzotriazole may be contained in the emulsion. Or, for the purpose of raising the processing capability of the processing solution, developing agents and inhibitors may be contained in a backing layer.

In embodying the invention, gelatin is used most advantageously as a hydrophilic colloid. Suitable hydrophilic colloids other than gelatin include, for example, colloidal albumin, agar, gum arabic, alginic acid, hydrolyzed cellulose acetate, polyacrylamide, iminated polyamide, polyvinyl alcohol, hydrolyzed polyvinyl acetate, gelatin derivatives such as phenyl carbamyl gelatin, acylated gelatin and phthalated gelatin described in U.S. Pat. Nos. 2,614,928, 2,525,753 as well as gelatins grafted with polymerizable ethylenic monomers, such as acrylic acid, styrene, acrylates, methacrylic acid, methacrylates, described in U.S. Pat. Nos. 2,548,520 and 2,831,767. These hydrophilic colloids can also be employed in a layer containing no silver halide such as an antihalation layer, a protective layer or an intermediate layer.

The total amount of gelatin on the emulsion layers side of the light-sensitive material of the invention is preferably 3.0 g/m$^2$ or less on the ground that the reactivity of a developing agent and silver halide in the developing solution is enhanced. In addition, when it is less than 1.5 g/m$^2$, photographic properties are deteriorated, for example, in terms of uneven development due to the deterioration of coating property in manufacturing. Therefore, the preferable range is 1.5 to 3.0 g/m$^2$ in the present invention.

Typical examples of the support used in the invention include baryta paper, polyethylene-coated paper, polypropylene synthetic paper, glass plates, cellulose acetate film, cellulose nitrate film, polyester film such as polyethylene terephthalate film, polyamide film, polypropylene film, polycarbonate film and polystyrene film. These supports are properly selected according to applications of respective silver halide photographic light-sensitive materials.

The developer according to the invention is employed in the pH range of 9.5 to 10.7. A pH lower than the above is impractical because it substantially lowers the activity of the developer, and a pH higher than the above deteriorates the stability of the developer in a prolonged operation and, moreover, lowers the contrast of a tetrazolium compound containing light-sensitive material.

In the invention, the organic solvent contained in the developer is an organic compound added to dissolve hydrophobic compounds such as a developing agent and an organic inhibitor; examples thereof include ethylene oxide compounds such as ethylene glycol, diethylene glycol, triethylene glycol, and polyethylene glycols having an average molecular weight of 200 or more; a polymer such as polyvinyl alcohol; alcohols such as ethanol and methanol; an organic solvent such as dimethylformamide; and an organic salt such as sodium toluenesulfonate. The amount of solvent contained in the developer ranges from 0 to 0.5 mol, preferably from 0 to 0.2 mol, per liter of liquid used. When the amount is larger than the above, the contrast is lowered in the processing of a hydrazine compound containing light-sensitive material and a tetrazolium compound containing light-sensitive material in the same processing bath.

There is no limitation to the amount of replenishing a developer. When a light-sensitive material is processed in an automatic processing machine, hydroguinone, which is a developing agent, is consumed so that the activity of the developer is reduced. By replenishing the developer, activity is kept constant. When a replenisher for the developer once prepared from a solid processing composition is stored in a reserving tank, activity of the developer is enhanced due to air-oxidation and evaporation of water. Accordingly, when the replenisher for the developer is replenished in a large amount, the activity of the developer is too much raised so that deterioration of the light-sensitive material such as fogging and black spots is caused. Therefore, according to the study of the present inventors, it was proven that the preferable amount of replenishing is 250 cc or less per m$^2$ of the light-sensitive material. The range of the replenishing amount of developer is preferably 60 to 250 cc, and more preferably 100 to 200 cc per m$^2$ of the light-sensitive material.

In the invention, the developing time means the time required of a light-sensitive material, which is just entering the developer with its one end, to reach the surface of the fixer, in processing using an automatic processor. In the embodiment of the invention, the developing time may be 18 seconds or less, and preferably 7 to 15 seconds.

The solid processing composition used in the invention includes those having the general form of solid such as, granule, tablet, paste or a mixture thereof. In case of being a paste, the viscosity is preferably 5 p or more.

The solid processing composition of the present invention is defined to be one solidifying a component essential for effecting as a developer. In other words, the solid processing composition of the present invention is a solidified component which can serve as a developer solution by adding only water thereto.

In dissolving the solid processing composition of the invention, either a manual method or a mechanical method may be used as in preparation of the usual solution. A replenishing tank may be provided on the inside or outside of an automatic processor. The processing composition may be supplied in any form as long as it is prevented from scattering. For example, the solid processing agent may be wrapped up in a water-soluble polymer film and thrown into a tank as it is, or it may be packaged with paper surface-treated with polyethylene or the like and added in a tank with care not to scatter or leave it in the packaging. In view of the solubility of the processing agent in water, granules and pellets are preferred as the form of solid. Some photographic processing components are sparingly soluble in water and apt to deposit in a processing solution. In order to avoid such deposition, a solvent may be added separately. In forming granules or pellets, use of a conventional granulation aid, such as a water-, alkali- or acid-soluble polymer, is preferred. In practice, there can be used, singly or in combination of two or more kinds, granulation aids selected from gelatin, pectin, polyacrylic acid, polyacrylic acid salts, polyvinyl alcohol, polyvinyl pyrrolidone, vinyl acetate copolymers, polyethylene oxide, sodium carboxymethyl cellulose, hydroxypropyl cellulose, methyl cellulose, ethyl cellulose, alginates, xanthan gum, gum arabic, gum traganth, carrageenan, methyl vinyl ether-maleic anhydride copolymers, polyoxyethylene alkyl ethers such as polyoxyethylene ethyl ether and polyoxyethylene stearyl ether, polyoxyethylene alkylphenol ethers such as polyoxyethylene octylphenol ether and polyoxyethylene nonylphenol ether, and the water-soluble binders described in Japanese Patent Publication Open to Public Inspection (hereinafter referred to as Japanese Pat. O.P.I. Pub.) No. 203165/1990.

The granulation aid used in the invention is preferably a water soluble polymer, such as polyvinyl alcohol, polyvinyl pyrrolidone, polyethylene glycol, and derivatives thereof, carboxymethyl cellulose and polyacrylic acid. The content of the granulation aid is 1 to 10% by weight, and preferably 2 to 5% by weight based on the total solid content of the solid composition.

In order to improve the preservability of a processing agent in the form of a kit, the processing agent may be packaged in two or more parts of the kit.

Developing agents of the black-and-white developer used in the invention are preferably a combination of dihydroxybenzenes and 1-phenyl-3-pyrazolidones because of its advantage of providing high performance stably. Of course, aminophenol type developing agents may be used besides the above developing agents.

The dihydroxybenzene developing agents used in the invention include hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Of them, hydroquinone is particularly preferred.

The developing agents 1-Phenyl-3-pyrazolidone or its derivatives used in the invention include 1-phenyl-4,4-dimethyl-3-pyrazolidone, 1-phenyl-4-methyl-4-hydroxymethyl-3-pyrazolidone, and 1-phenyl-4,4-dihydroxymethyl-3-pyrazolidone.

p-Aminophenol developing agents used in the invention include N-methyl-p-aminophenol, p-aminophenol, N-(β-hydroxyethyl)-p-aminophenol, N-(4-hydroxyphenyl)glycine, 2-methyl-p-aminophenyl, and p-benzylaminophenyl. Among them, preferred is N-methyl-p-aminophenol.

These developing agents are usually employed in an amount of 0.01 to 1.2 mol per litre of the developer.

Sulfite preservatives used in the invention include sodium sulfite, potassium sulfite, lithium sulfite, ammonium sulfite, sodium bisulfite, potassium metabisulfite, and sodium formaldehyde bisulfite. Preferably, these sulfites are used in an amount of 0.2 mol or more and preferably 0.4 mol or more, within the limit of 2.5 mol per litre of the developer.

In the embodiment of the invention, the pH of the developer is used in the invention 10.7 or less, preferably 9.5 to 10.7. As alkali agents for adjusting the pH, there can be used pH adjustors such as sodium hydroxide, potassium hydroxide, sodium carbonate, potassium carbonate, tribasic sodium phosphate, and tribasic potassium phosphates.

There may also be used buffering agents such as the ones described in Japanese Pat. O.P.I. Pub. No. 28708/1986 (borates), ones described in Japanese Pat. O.P.I. Pub. No. 93439/1985 (e.g., saccharose, acetoxime, 5-sulfosalicylic acid), phosphates, and carbonates.

Besides the above components, the developer used in the invention may contain developing inhibitors such as sodium bromide, potassium bromide; organic solvents such as ethylene glycol, diethylene glycol, triethylene glycol, dimethylformamide, methyl cellosolve, hexylene glycol, ethanol, methanol; and antifoggants such as mercapto compounds including 1-phenyl-5-mercaptotetrazole, sodium 2-mercaptobenzimidazole-5-sulfonate, indazole compounds including 5-nitroindazole and benzotriazole compounds including 5-methylbenzotriazole. If necessary, there may further be contained tone controlling agents, surfactants, defoamers, water softeners, and the amino compounds described in Japanese Pat. O.P.I. Pub. No. 106244/1981.

The developer used in the present invention may further contain a chelating agent.

The chelating agent used in the present invention whose chelating compound with ferric ion ($Fe^{3+}$) having a chelating stability constant of 8 or more is preferable. Here, "chelating stability constant" is defined to be a constant commonly known by "Stability Constants of Metal Complexes" written by L. G. Silen and A. E. Martell, The Chemical Society, London (1964), "Organic Sequestering Agents" written by S. Chaberek and A. E. Martell, Willey (1959). In the present invention, as the chelating agents whose chelating compound with ferric ion ($Fe^{3+}$) having a chelating stability constant of 8 or more, organic carboxyl acid chelating agents, organic phosphoric acid chelating agents, inorganic phosphoric acid chelating agents and polyhydroxy compounds are cited. The chelating agents used in the present invention include ethylenediamine-orthohydroxylphenylacetic acid, hydroxyethylethylene-diaminetriacetic acid, ethylglycine, ethylenediamine-2-propionic acid, imino-2-acetic acid, diethylenetriamine-pentaacetic acid, hydroxyethylimino-2-acetic acid, 1,3-diaminopropanoltetraacetic acid, triethylenetetraminehexaacetic acid, transcyclohexadiaminetetraacetic acid, glycoletherdiaminetetraacetic acid, ethylenediaminetetrakismethylenephosphonic acid. However, the present invention is not limited thereto.

Of them, it is especially preferable to use polyamino carboxylic acid type and/or polyamino phosphoric acid type compounds. The amount used of the above-mentioned chelating agent in the present invention is 0.01 to 20 g, and preferably 0.1 to 10 g per 1 liter of developing solution, giving favorable results. The chelating agent of the present invention may be incorporated in a solid processing composition.

Further, the developer used in the invention may employ silver stain inhibitors, for example, those described in Japanese Pat. O.P.I. Pub. No. 24347/1981. The developer of the invention may contain amino compounds such as the alkanolamines described in Japanese Pat. O.P.I. Pub. No. 106244/1981.

The developer used in the invention preferably contains a silver stain inhibitor represented by the following Formula A:

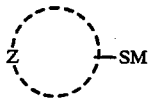

Formula A wherein Z represents a heterocycle containing nitrogen; and M represents a hydrogen atom or a cation such as an alkali metal ion, an alkaline earth metal ion or an ammonium ion. In addition, a compound represented by Formula A contains in its structure at least one group selected from a sulfo group, a carboxy group and a hydroxy group. In Formula A, the following compounds can preferably be used:

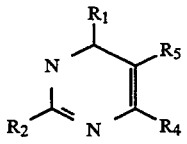

A-1

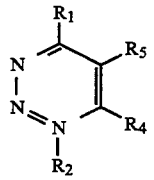

A-2

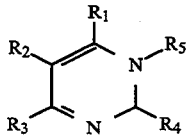

A-3 wherein $R_1$, $R_2$ and $R_3$ independently represent a hydrogen atom, a halogen atom, a lower alkyl group (including those having a substituent, those having 5 or less carbon atoms such as a methyl group and an ethyl group are preferable), a hydroxy group, a sulfo group, a lower alkenyl group (those having a substituent, those having 5 or less carbon atoms are preferable), an amino group, a COOM group (M represents the same as the above-mentioned M), a carbamoyl group, an aryl group (a phenyl group and a naphthyl group are preferable) a mercapto group provided that at least one of $R_1$, $R_2$, and $R_3$ is a mercapto group; $R_4$ and $R_5$ independently represent a sulfo group, a phosphono group, an amino group, an alkyl group, an aralkyl group, an alkoxycarbonyl group, an aryloxycarbonyl group, a carbamoyl group, an aryl group, a mercapto group (the above-mentioned groups may have a substituent), a hydrogen atom, a nitro group, a halogen atom, a hydroxy group or a cyano group, provided that $R_4$ and $R_5$ may combine to form a ring.

As the silver stain inhibitor preferably used in the present invention, those described from the 8th line of 29th column on page 16 to the 46th line of 35th column on page 19 of Japanese Patent O.P.I. Publication No. 61158/1993, those described from 4th line of 4th column on page 2 to 5th line of 6th column on page 3 of Japanese Patent Publication No. 4720/1987 and those described in Japanese Patent O.P.I. Publication No. 106244/1981 can be used. Practically, the following compounds are used:

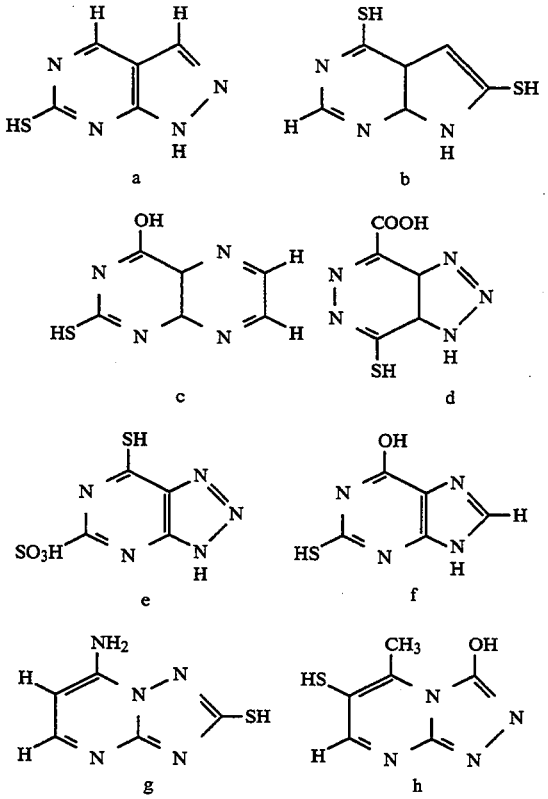

In addition, there may also be used the compounds described on pages 226–229 of "Photographic Processing Chemistry" by L. F. A. MESON, Focal Press Co. (1966), in U.S. Pat. Nos. 2,193,015, 2,592,364 and Japanese Pat. O.P.I. Pub. No. 64933/1973.

A fixer is usually an aqueous solution containing a thiosulfate and having a pH of 3.8 or more, preferably 4.2 to 5.5. As such a fixer, one prepared from a solid processing agent is preferred. The term "solid" used here is the same as that defined with respect to the developer.

A fixing agent includes, for example, sodium thiosulfate and ammonium thiosulfate. Preferred are those containing thiosulfate ions and ammonium ions as essential components; particularly preferred is ammonium thiosulfate in view of its fixing speed.

The content of the fixing agent can be varied according to specific requirements, but it is usually within the range of about 0.1 to about 6 mol per litre of the fixer.

The fixer may contain a water-soluble aluminum salt which functions as a hardener. Examples thereof include aluminum chloride, aluminum sulfate and potassium alum.

Further, the fixer may use, singly or in combination, tartaric acid, citric acid and their derivatives. A fixer which contains these compounds in an amount of 0.005 mol/l or more is effective in embodying the invention; one containing them in an amount of from 0.01 mol/l to 0.03 mol/l is particularly effective.

Suitable examples include tartaric acid, potassium tartrate, sodium tartrate, potassium sodium tartrate, citric acid, sodium citrate, potassium citrate, lithium citrate and ammonium citrate.

When necessary, the fixer may contain preservatives such as sulfites, bisulfite; pH buffering agents such as acetic acid, nitric acid; pH adjustors such as sulfuric acid; and chelating agents having water-softening capabilities.

EXAMPLES

The invention is illustrated in detail with the following examples, but the scope of the invention is not limited to these examples.

EXAMPLE 1

Preparation of Light-sensitive Material No. 1 (Tetrazolium compound containing Light-sensitive Material)

Synthesis of Latex Lx-2

To 40 liters of water containing 1.25 kg of gelatin and 0.05 kg of ammonium persulfate was added 7.5 g of sodium dodecylbenzene sulfonate. While the solution was stirred at 50° C., a mixture of the following monomers A to D was added thereto under a nitrogen atmosphere at an addition rate to give an average finished particle size of 0.10μ. After stirring the reaction mixture for 3 hours, 0.05 kg of ammonium persulfate was added thereto, followed by a 1.5-hour stirring to complete the reaction. Then, the reaction mixture was steam distilled for 1 hour to remove unreacted monomers, cooled to room temperature, adjusted to pH 6.0 with ammonium and made up to 80.5 kg with water.

| | |
|---|---|
| Monomer A: ethyl acrylate | 5.0 kg |
| Monomer B: methyl methacrylate | 1.4 kg (35° C.) |
| Monomer C: styrene | 3 kg |
| Monomer D: sodium acrylamide-2-methylpropanesulfonate | 0.6 kg |

Preparation of Emulsion

An aqueous solution of silver nitrate and an aqueous solution of sodium chloride and potassium bromide containing hexachlororhodium complex in an amount of $8\times10^{-4}$ mol/mol Ag were simultaneously added to an aqueous solution of gelatin at a controlled addition rate, followed by desalting. Obtained was an emulsion comprising monodispersed cubic silver chlorobromide grains having an average grain size of 0.13μ and a silver bromide content of 1 mol %.

After subjecting the emulsion to sulfur sensitization by the usual method, 6-methyl-4-hydroxy-1,3,3a,7-tetrazaindene was added as a stabilizer. The following additives were further added to obtain emulsion coating solutions E-1 to E-14. Then, emulsion-protecting layer coating solution P-0, backing layer coating solution B-0 and backing-protecting layer coating solution BP-0 were prepared, each of which had the following composition.

| Emulsion Coating solution | |
|---|---|
| Compound (a) | 1 mg/m² |
| NAOH (0.5 N) | to adjust the pH to 5.6 |
| Compound (b) tetrazolium compound T-7 | 40 mg/m² |
| Saponin (20%) | 0.5 ml/m² |
| Sodium dodecylbenzene sulfonate | 20 mg/m² |
| 5-Methylbenzotriazole | 10 mg/m² |
| Compound (d) | 2 mg/m² |
| Compound (e) | 10 mg/m² |
| Compound (f) | 6 mg/m² |
| Latex Lx-2 | 0.5 g/m² |
| Styrene-maleic acid copolymer (thickener) | 90 mg/m² |

(a) A 50:46:4 mixture of compound A:compound B:compound C

-continued

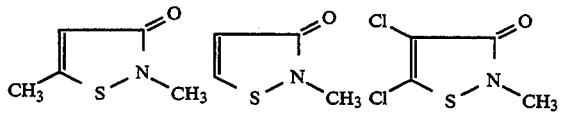

(b)

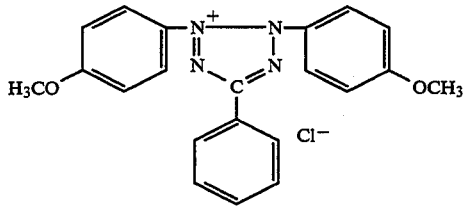

Tetrazolium compound T-7

(d)

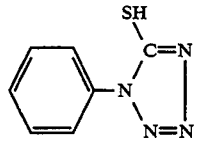

(e)

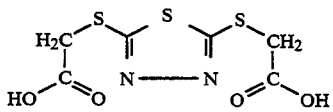

(f)

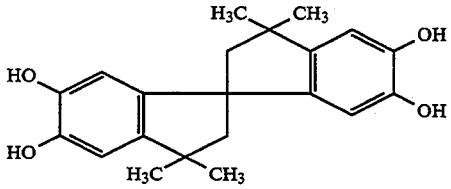

| Emulsion-protecting Layer Coating Solution P-0 | |
|---|---|
| Gelatin | 0.5 g/m² |
| Compound (g) (1% solution) | 25 ml/m² |
| Compound (h) | 120 mg/m² |
| Spherical monodispersed silica particles (size: 8 μm) | 20 mg/m² |
| Spherical monodispersed silica particles (size: 3 μm) | 10 mg/m² |
| Compound (i) | 100 mg/m² |
| Latex Lx-2 | 0.5 g/m² |
| Citric acid | to adjust the pH to 6.0 |

| Backing Layer Coating Solution B-0 | |
|---|---|
| Gelatin | 1.0 g/m² |
| Compound (j) | 100 mg/m² |
| Compound (k) | 18 mg/m² |
| Compound (1) | 100 mg/m² |
| Saponin (20%) | 0.6 ml/m² |
| Compound (m) | 300 mg/m² |
| 5-Nitroindazole | 20 mg/m² |
| Styrene-maleic acid copolymer (thickener) | 45 mg/m² |
| Glyoxal | 4 mg/m² |
| Compound (o) | 100 mg/m² |

| Backing-protecting Layer Coating Solution P-0 | |
|---|---|
| Gelatin | 0.5 g/m² |
| Compound (g) (1% solution) | 2 ml/m² |
| Spherical Polymethylmethacrylate particles (size: 4 μm) | 25 mg/m² |
| Sodium chloride | 70 mg/m² |
| Glyoxal | 22 mg/m² |
| Compound (n) | 10 mg/m² |

-continued (g)

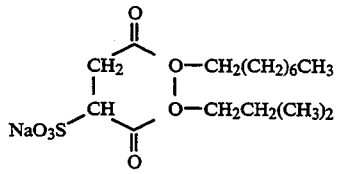

(h)

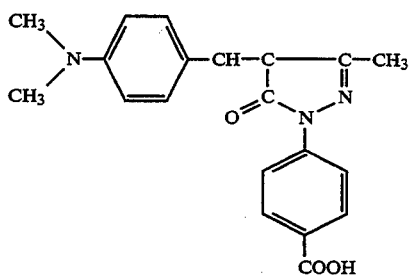

= solid disperse dye (i)

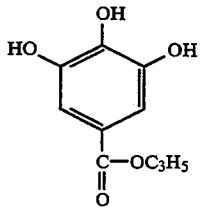

(j)

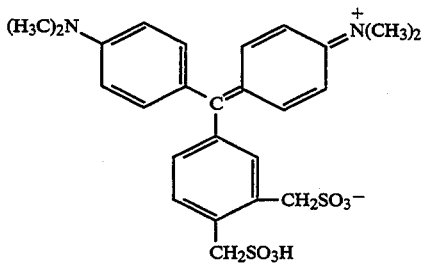

(k)

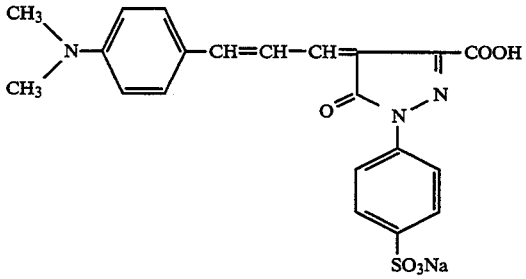

-continued (l)

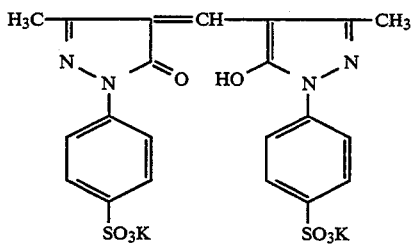

(m)

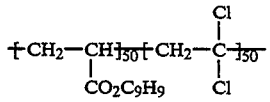

(n)

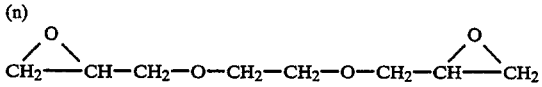

(o)

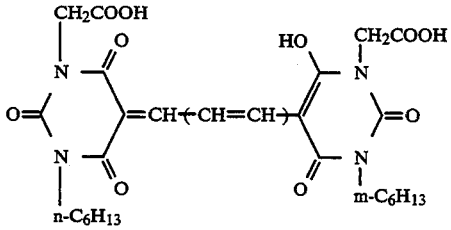

Prior to the addition, this was dissolved in an aqueous solution of sodium hydroxide with pH 12 to a concentration of 5% and then the solution was adjusted to pH 6 with acetic acid.

A 100-μm thick polyethylene terephthalate base was subbed on the emulsion layer side in the manner shown in Japanese Pat. O.P.I. Pub. No. 19941/1984, subjected to corona discharge of 10 $W/m^2 \cdot min$, and then coated with the following composition using a roll-fit coating pan and an air knife. Drying was performed at 90° C. for 30 minutes in a parallel flow drying mode at an overall heat transfer coefficient of 25 Kcal ($m^2 \cdot hr \cdot °C$), followed by further dying at 140° C. for 90 seconds. This layer had a dry coating thickness of 1 μm and a surface specific resistance of $1 \times 10^8$ Ω at 23° C. and 55% RH.

| | |
|---|---|
| Water-soluble polymer | 70 g/l |

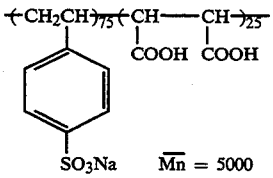

| | |
|---|---|
| Hydrophobic polymer particles | 40 g/l |

-continued

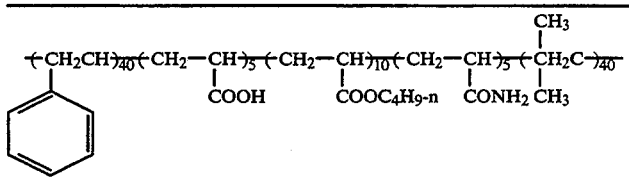

| | |
|---|---|
| Ammonium sulfate | 0.5 g/l |
| Polyethylene oxide compound (average molecular weight: 60) | 6 g/l |
| Curing agent | 12 g/l |
| Mixture of | |

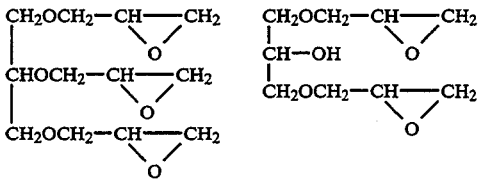

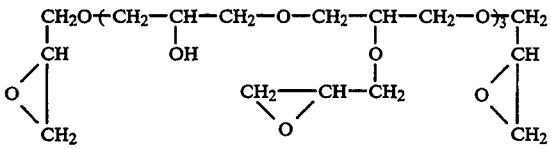

As component layers on the emulsion layer side, an emulsion layer and an emulsion-protecting layer were formed in this order on the above base by coating simultaneously and double-layeredly, using the sliding hopper method, the respective coating solutions kept at 35° C., while adding, as a hardener, a formalin solution thereto so as to give a formalin content of 30 mg/g gelatin. After passing the coated web through a cold-air setting zone kept at 5° C., the backing layer coating solution and the backing-protecting layer coating solution were coated thereon by the sliding hopper method while adding the hardener to the solutions, followed by cold-air setting at 5° C. Each coating solution exhibited a good setting property when passed through the respective cold-air setting zones. Subsequently, the coated web was introduced into a drying zone where its both sides were subjected to simultaneous drying under the following conditions. Incidentally, after finishing the coating on the backing layer side, conveyance of the coated web till it being wound up was made with rollers and other conveying members prevented from coming into contact with the web. The coating speed was 100 m/min.

Drying Conditions

After the cold-air setting, drying was carried out firstly by sensing dry air of 30° C. till the water/gelatin ratio became 800% by weight, drying was continued by sending dry air kept at 35° C. and 30% RH till the water/gelatin ratio reached 200%, and the air was further allowed to blow in. Thirty seconds after the surface temperature of the web reached 34° C. (drying was regarded to have finished), drying was further carried out for 1 minute by sending air of 48° C. and 2% RH. In the above drying process, the drying time from the start of drying to the point at which the water/gelatin ratio decreased to 800% was 50 seconds, that from 800% to 203% was 35 seconds, and that from 200% to the end of drying was 5 seconds.

The resulting light-sensitive material was wound up in an environment of 23° C. and 40% RH, cut in the same environment, and then hermetically sealed in a barrier bag conditioned for 3 hours in the same environment together with thick paper conditioned for 8 hours at 40° C. and 10% RH and further conditioned for 2 hours at 23° C. and 30% RH.

In this light-sensitive material, the coating weight of silver was 4.0 g/m$^2$, and the coating weight of gelatin was 2.0 g/m$^2$.

Light-sensitive Material No. 2 (Hydrazine compound containing Light-sensitive Material)

Preparation of Silver Halide Photographic Emulsion

A silver iodobromide emulsion (silver iodide content: 0.7 mol % per mol of silver) was prepared by use of a double-jet mixing method. In the preparation, $K_2IrCl_6$ was added in an amount of $8\times10^{-7}$ mol per mol of silver while mixing was carried out. Obtained was an emulsion comprising cubic monodispersed grains having an average grain size of 0.20 μm and a coefficient of variation of grain size of 9%. After adding sensitizing dye SD-1 in an amount of 8 mg/m$^2$, the emulsion was washed and desalted by the usual method. The pAg of the desalted emulsion was 8.0 at 40° C. Subsequently, an aqueous solution of potassium iodide was added to the emulsion in an amount of 0.1 mol % per mol of silver to convert the surface composition of the grains, and then a mixture of compounds [A], [B] and [C] was added in an amount of 7 mg/m$^2$, followed by sulfur sensitization. Emulsion A was thus obtained.

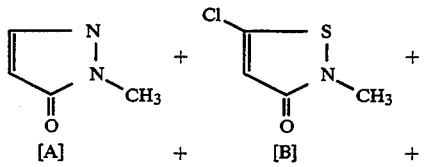

[A] + [B] +

-continued

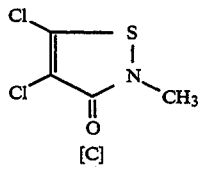

[C]

[A]:[B]:[C] = 50:46:4 (weight ratio)

Preparation of Silver Halide Photographic Light-sensitive Material

On one side of a 100-μm thick polyethylene terephthalate film provided with a 0.1 mm-thick subbing layer (see Example 1 of Japanese Pat. O.P.I. Pub. No. 19941/1984) on both sides was formed a silver halide emulsion layer of the following formulation (1), so as to give a gelatin weight of 2.0 g/m$^2$ and a silver weight of 3.2 g/m$^2$. Then, an emulsion-protecting layer of the following formulation (2) was formed thereon so as to give a gelatin weight of 1.0 g/m$^2$ and, on the other side, a backing layer of the following formulation (3) was formed so as to give a gelatin weight of 2.4 g/m$^2$, and further a backing-protecting layer of the following formulation (4) was formed thereon so as to give a gelatin weight of 1 g/m$^2$.

Formulation (1) (Silver Halide Emulsion Layer Composition)

| | |
|---|---|
| Gelatin | 2.0 g/m$^2$ |
| Silver halide emulsion (in silver weight) | 3.2 g/m$^2$ |
| Sensitizing dye: SD-1 | 6.0 mg/m$^2$ |

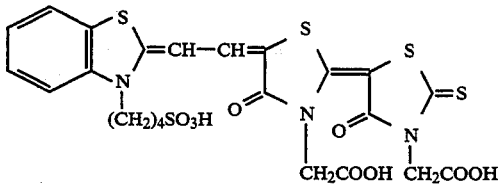

| | |
|---|---|
| Sensitizing dye: SD-2 | 1.0 mg/m$^2$ |

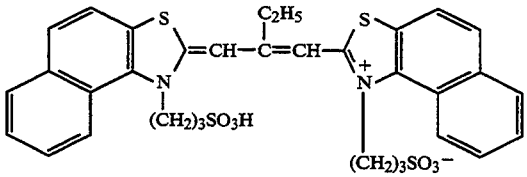

| | |
|---|---|
| Stabilizer: 4-methyl-6-hydroxy-1,3,3a,7-tetrazaindene | 30 mg/m$^2$ |
| Antifoggant: | |
| adenine | 10 mg/m$^2$ |
| 1-phenyl-5-mercaptotetrazole | 5 mg/m$^2$ |
| Surfactant: saponin | 0.1 g/m$^2$ |
| Surfactant: S-1 | 8 mg/m$^2$ |

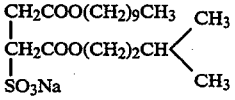

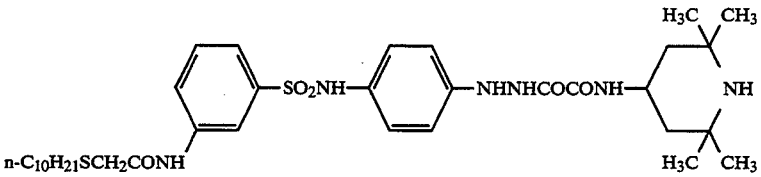

| | |
|---|---|
| Nucleation accelerator: N-11 | 20 mg/m$^2$ |
| Latex polymer: Lx-1 | 20 mg/m$^2$ |
| | 1 g/m$^2$ |

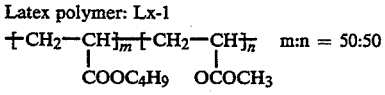

| | |
|---|---|
| Polyethylene glycol (MW: 4000) | 0.1 g/m$^2$ |
| Hardener: H-1 | 60 mg/m$^2$ |

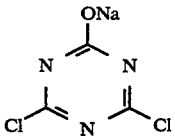

Formulation (2) (Emulsion-protecting Layer Composition)

-continued

| | |
|---|---|
| Gelatin | 1.0 g/m$^2$ |
| Surfactant: S-2 | 10 g/m$^2$ |

$CH_2COOCH_2(C_2H_5)C_4H_9$
|
$CHCOOCH_2CH(C_2H_5)C_4H_9$
|
$SO_3Na$

| | |
|---|---|
| Surfactant: S-3 | 5 mg/m$^2$ |

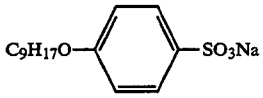

| | |
|---|---|
| Matting agent: monodispersed silica with average particle size of 3.5 μm | 5 mg/m$^2$ |
| Hardener: 1,3-vinylsulfonyl-2-propanol | 40 mg/m$^2$ |

Formulation (3) (Backing Layer Composition)

(a)

70 mg/m$^2$

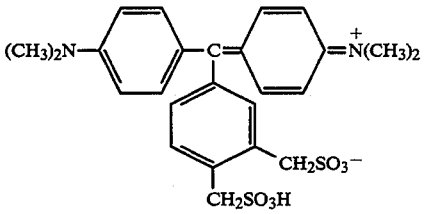

(b)

50 mg/m$^2$

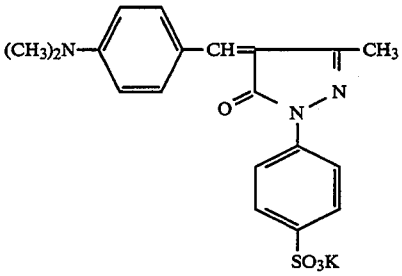

(c)

20 mg/m$^2$

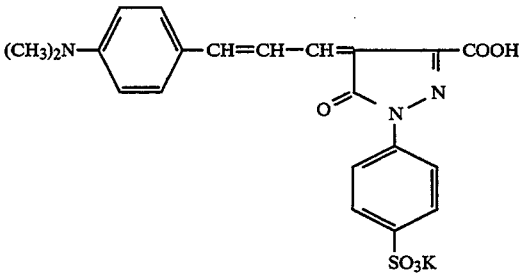

| | |
|---|---|
| Gelatin | 2.4 g/m$^2$ |
| Surfactant: saponin | 0.1 g/m$^2$ |
| Surfactant: S-1 | 6 mg/m$^2$ |
| Colloidal silica | 100 mg/m$^2$ |

Formulation (4) (Backing-protecting Layer Composition)

| | |
|---|---|
| Gelatin | 1 g/m$^2$ |
| Matting agent: monodispersed polymethylmethacrylate with average particle size of 3.5 μm | 40 mg/m$^2$ |
| Surfactant: S-2 | 10 mg/m$^2$ |
| Hardener: glyoxal | 25 mg/m$^2$ |
| Hardener: H-1 | 35 mg/m$^2$ |

Preparation of Developer A

A developer of the following composition was prepared.

| | |
|---|---|
| Sodium sulfite | 55 g/l |
| Potassium carbonate | 25 g/l |

-continued

| | |
|---|---|
| Hydroquinone | 24 g/l |
| 4-Methyl-4-hydroxymethyl-1-phenyl-3-hydrazolidone (Dimezone S) | 0.9 g/l |
| Potassium bromide | 5 g/l |
| Benzotriazole | 0.13 g/l |
| 1-Phenyl-5-mercaptotetrazole | 0.02 g/l |
| Boric acid | 2.2 g/l |
| Diethylene glycol | 40 g/l |

Water and potassium hydroxide were added to make up to 1 liter and pH 10.5.

Preparation of Developers B, C, D and E

Developers B, C, D and E were prepared in the same manner as in developer A, except that the pH was varied as shown in Table 1 by varying the addition amount of potassium hydroxide.

Preparation of Developers F, G and H

Developers F, G and H were prepared in the same manner as in developer A, except that the addition amount of diethylene glycol was varied as shown in Table 1.

Preparation of Developer I, J and K

Developers I, J and K were prepared in the same manner as developer A, except that the solvents shown in Table 1 were used in place of diethylene glycol.

Preparation of Developer L

The following solid developing composition part (a) was mixed uniformly. The mixture was stirred in a commercial stirring granulator to form granules while adding there to 10 wt % water as a binder, and then dried by blowing air heated to 70° C. to the stirring granulator. The resulting granules were classified by the sizes of particle diameter using sieves. The size distribution of the granules was as follows:

| | |
|---|---|
| Less than 0.5 mm | 16% |
| 0.5 mm to less than 1.0 mm | 12% |
| 1.0 mm to less than 2.0 mm | 64% |
| 2.0 mm or more | 8% |

The following solid developer part (b) was also granulated likewise. The size distribution of the resulting granules was as follows:

| | |
|---|---|
| Less than 0.5 mm | 20% |
| 0.5 mm to less than 1.0 mm | 8% |
| 1.0 mm to less than 2.0 mm | 65% |
| 2.0 mm or more | 7% |
| Solid Developer part (a) | |
| Sodium sulfite | 55 g/l liquid developer |
| Potassium carbonate | 25 g/l liquid developer |
| Potassium hydroxide | 10 g/l liquid developer |
| Solid Developer part (b) | |
| Hydroquinone | 24 g/l liquid developer |
| 4-Methyl-4-hydroxymethyl-1-phenyl-3-pyrazolidone (Dimezone S) | 0.9 g/l liquid developer |
| Potassium bromide | 5 g/l liquid developer |
| Benzotriazole | 0.13 g/l liquid developer |
| 1-Phenyl-5-mercaptotetrazole | 0.02 g/l liquid developer |
| Boric acid | 2.2 g/l liquid developer |

A liquid developer was prepared by dissolving solid developers part (a) and part (b) in a prescribed volume of water.

Evaluation

A part of light-sensitive material No.1 was exposed through an optical wedge on a Dainippon Screen P-627-FM room-light printer. On the other hand, a part of light-sensitive material No.2 was exposed in $10^{-6}$ second through an optical wedge using a helium-neon laser. Further, light-sensitive material Nos. 1 and 2 were each cut into 610×500 mm size sheets. Among these cut sheets, a part of light-sensitive material No.1 was subjected to overall exposure on the room-light printer, and a part of light-sensitive material No.2 was exposed overall in $10^{-6}$ second using the helium-neon laser.

The above obtained samples were continuously processed, with an alternation of light-sensitive material No.1 and light-sensitive material No.2, in a Konica GR-26SR automatic processor under the following processing and replenishing conditions. In the processing, overall exposed samples were processed at the ratio of one to five sheets.

| | Processing Temp. | Processing Time | Replenishing Rate |
|---|---|---|---|
| Developing | 35° C. | 12 sec | 163 ml/m$^2$ |
| Fixing | 33° C. | 12 sec | 196 ml/m$^2$ |
| Washing | room temp. | 10 sec | 2,290 ml/m$^2$ |
| Drying | 45° C. | 10 sec | — |

Further, the wedgewise exposed light-sensitive material Nos.1 and 2 were processed after processing 100 sheets of the 610×500 mm size light-sensitive materials, followed by densitometry. Moreover, photographic characteristic curves were obtained, and the tangents of a straight line obtained combining the points of density 0.3 and density 3.0 were recorded as the contrast γ. The evaluation results are summarized in Table 1.

TABLE 1

| Developer | pH | Solvent Kind | Solvent mol/L | Light-sensitive Material No. 1 Maximum Density γ | | Light-sensitive Material No. 2 Maximum Density γ | | |
|---|---|---|---|---|---|---|---|---|
| A | 10.5 | DEG | 0.38 | 5.6 | 9.5 | 5.6 | 12.5 | Invention |
| B | 9.2 | DEG | 0.38 | 4.3 | 9.3 | 4.6 | 11.5 | Comparison |
| C | 9.5 | DEG | 0.38 | 5.4 | 9.5 | 5.4 | 12.0 | Invention |
| D | 10.7 | DEG | 0.38 | 5.8 | 9.5 | 5.5 | 12.5 | Invention |
| E | 11.0 | DEG | 0.38 | 6.2 | 6.0 | 5.5 | 12.5 | Comparison |
| F | 10.5 | DEG | 0.47 | 5.7 | 9.5 | 5.5 | 12.0 | Invention |
| G | 10.5 | DEG | 0.56 | 5.2 | 9.3 | 5.4 | 11.5 | Invention |
| H | 10.5 | DEG | 0.19 | 5.8 | 9.6 | 5.6 | 12.5 | Invention |
| I | 10.5 | TBG | 0.20 | 5.8 | 9.4 | 5.4 | 12.0 | Invention |
| J | 10.5 | PVA | 0.20 | 5.7 | 9.5 | 5.4 | 12.5 | Invention |
| K | 10.5 | Na toluenesulfonate | 0.20 | 5.8 | 9.3 | 5.4 | 12.5 | Invention |
| L | 10.5 | none | — | 5.8 | 9.9 | 5.8 | 12.5 | Inven- |

TABLE 1-continued

| Developer | pH | Solvent Kind | Solvent mol/L | Light-sensitive Material No. 1 Maximum Density γ | Light-sensitive Material No. 2 Maximum Density γ | |
|---|---|---|---|---|---|---|
| | | | | | | tion |

It can be understood from the above results that the processing with the developer maintained in the pH range of 9.5 to 10.7 according to the invention can give favorable results to both the light-sensitive materials. Further, processing with the solvent content of 0.5 mol/l or more can provide better photographic properties. The developer prepared from a solid processing composition can give still better photographic properties.

EXAMPLE 2

The test was conducted in the same manner as in Example 1, except that a silver stain inhibitor and a chelating agent were added to developing solution F used in Example 1. In order no evaluate color remaining property of the processed material, transmittance at 640 nm of an unexposed portion light-sensitive material No. 2 was measured. The higher the transmittance, the better the color remaining property. The results are shown in Table 2.

TABLE 2

| Developer | Silver stain inhibitor Compound | Silver stain inhibitor Amount added g/l | Chelating agent Compound | Chelating agent Amount added g/l | Light-sensitive material No. 1 Dmax γ | | Light-sensitive material No. 2 Dmax γ | | Color remaining property % |
|---|---|---|---|---|---|---|---|---|---|
| F-1 | f | 0.09 | | | 5.7 | 10.0 | 5.5 | 12.2 | 72 |
| F-2 | h | 0.09 | | | 5.7 | 9.9 | 5.4 | 12.1 | 89 |
| F-3 | | | (1) | 1.0 | 5.7 | 9.9 | 5.4 | 12.1 | 89 |
| F-4 | | | (2) | 1.0 | 5.8 | 10.0 | 5.6 | 12.1 | 90 |
| F-6 | | | EDTA* | 1.0 | 5.7 | 9.6 | 5.6 | 12.1 | 73 |

(1) Glycolether diamine tetraacetic acid
(2) Diethylenetriaminepentaacetic acid
*Ethylenediaminetetraacetic acid As is shown above, the use of the chelating agent and the silver stain inhibitor of the present invention gives further favorable results in terms of γ value and color remaining property.

What is claimed is:

1. A method for processing both a first black and white silver halide photographic light-sensitive material and a second black and white silver halide photographic light-sensitive material, with a common developer, said first black and white silver halide photographic light-sensitive material comprising a support having provided thereon a first photographic component layer comprising a silver halide emulsion layer containing a hydrazine compound and gelatin in an amount of not more than 3.0 g per $m^2$ of material, said second black and white silver halide photographic light-sensitive material comprising a support having provided thereon a second photographic component layer comprising a silver halide emulsion layer containing a tetrazolium compound, and gelatin in an amount of not more than 3.0 g per $m^2$, said method comprising:

exposing each of said first black and white silver halide photographic light-sensitive material and said second black and white silver halide photographic light-sensitive material to form exposed materials;

developing said exposed materials with a developer having a pH of 9.5 to 10.7, said developer containing a chelating agent and a silver stain inhibitor, said developer being replenished with a developer replenisher in an amount of 60 to 250 cc/$m^2$ of light-sensitive material being developed to form developed materials; and fixing said developed materials with a fixer, wherein said silver stain inhibitor is selected from the group consisting of compounds represented by Formulas A-1, A-2, and A-3:

A-1

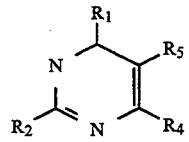

A-2

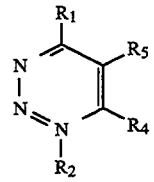

A-3

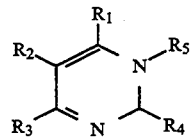

wherein $R_1$, $R_2$, and $R_3$ independently represent hydrogen, halogen, lower alkyl, hydroxy, sulfo, lower alkenyl, amino, COOM, in which M represents hydrogen or a cation, carbamoyl, aryl, or mercapto, provided that at least one of $R_1$, $R_2$, and $R_3$ is mercapto; $R_4$ and $R_5$ independently representing sulfo, phosphono, amino, alkyl, arylalkyl, alkoxycarbonyl, aryloxycarbonyl, carbamoyl, aryl, mercapto, nitro, hydroxy, cyano, or hydrogen, provided that $R_4$ and $R_5$ may combine to form a ring.

2. The method of claim 1, wherein said developing is carried out in not more than 18 seconds.

3. The method of claim 1, wherein said developer is prepared from a solid developing composition.

4. The method of claim 1, wherein said hydrazine compound has a dissolution inhibiting group.

5. The method of claim 4, wherein said hydrazine compound is represented by the following Formula (H):

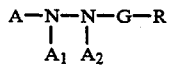

Formula (H)

wherein A represents an aryl group or a heterocyclic group containing a sulfur atom or an oxygen atom; G represents a

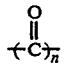

group, a sulfonyl group, a sulfoxy group, a

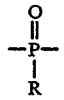

group or an iminomethylene group wherein n is an integer of 1 or 2; $A^1$ and $A^2$ represent a hydrogen atom or when one of $A^1$ and $A^2$ is a hydrogen atom, the other is an alkylsulfonyl group or an acyl group; R represents a hydrogen atom, an alkyl group, an aryl group, an alkoxy group, an aryloxy group, an amino group, a carbamoyl group, an oxycarbonyl group or —O—$R_2$ wherein $R_2$ represents a saturated heterocyclic group.

6. The method of claim 5, wherein the hydrazine compound is represented by the following Formula (H-c) or (H-d):

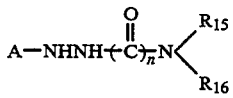

Formula (H-c)

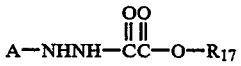

Formula (H-d)

wherein A represents an aryl group or a heterocyclic group containing a sulfur atom or an oxygen atom; n is an integer of 1 or 2; $R_{15}$ and $R_{16}$ independently represent a substituent; and $R_{17}$ represents an alkynyl group or a saturated heterocyclic group; wherein, when n is 1, said substituent represents a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group or a heterocyclicoxy group or $R_{15}$ and $R_{16}$ may form a ring together with a nitrogen atom or when n is 2, said substituent represents a hydrogen atom, an alkyl group, an alkenyl group, an alkynyl group, an aryl group, a heterocyclic group, a hydroxy group, an alkoxy group, an alkenyloxy group, an alkynyloxy group, an aryloxy group or a heterocyclicoxy group, provided that at least one of $R_{15}$ and $R_{16}$ represents an alkenyl group, an alkynyl group, a saturated heterocyclic group, a hydroxy group, an alkoxy group, an alkenyloxy group, an alkynyloxy group, an aryloxy group or a heterocyclicoxy group.

7. The method of claim 1, wherein said tetrazolium compound is represented by the following Formula (T):

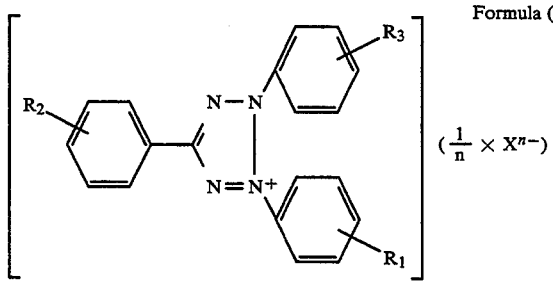

Formula (T)

wherein $R_1$, $R_2$ and $R_3$ independently represent a hydrogen atom group having a negative or positive Hammett's sigma value; $X^-$ represents an anion; and n represents 1 or 2.

8. The method of claim 7, wherein said $R_1$, $R_2$ and $R_3$ in Formula (T) independently represent a group having a negative Hammett's sigma value.

9. The method of claim 1 wherein said developer comprises a solvent in an amount of not more than 0.5 mols per liter.

10. The method of claim 1 wherein said chelating agent is selected from the group consisting of ethylenediamine-orthohydroxylphenylacetic acid, hydroxyethylethylene-diaminetriacetic acid, ethylglycine, ethylenediamine-2-propionic acid, imino-2-acetic acid, diethylenetriamine-pentaacetic acid, hydroxyethylimino-2-acetic acid, 1,3-diaminopropanoltetraacetic acid, triethylenetetramine-hexaacetic acid, transcyclohexadiaminetetraacetic acid, glycoletherdiamine-tetraacetic acid, and ethylenediaminetetrakismethylenephosphonic acid.

* * * * *